US008269801B2

(12) United States Patent
Campbell

(10) Patent No.: US 8,269,801 B2
(45) Date of Patent: Sep. 18, 2012

(54) UNIPOLAR GRAY SCALE DRIVE SCHEME FOR CHOLESTERIC LIQUID CRYSTAL DISPLAYS

(75) Inventor: Patrick M. Campbell, St. Paul, MN (US)

(73) Assignee: 3M Innovative Properties Company, Saint Paul, MN (US)

( * ) Notice: Subject to any disclaimer, the term of this patent is extended or adjusted under 35 U.S.C. 154(b) by 1029 days.

(21) Appl. No.: 12/236,941

(22) Filed: Sep. 24, 2008

(65) Prior Publication Data

US 2010/0073405 A1 Mar. 25, 2010

(51) Int. Cl.
*G09G 5/10* (2006.01)

(52) U.S. Cl. ..... 345/690

(58) Field of Classification Search ..... 345/690
See application file for complete search history.

(56) References Cited

U.S. PATENT DOCUMENTS

| | | | | |
|---|---|---|---|---|
| 4,241,344 | A | 12/1980 | Kmetz et al. | |
| 4,386,350 | A | 5/1983 | Ogawa | |
| 4,890,902 | A | 1/1990 | Doane et al. | |
| 5,384,067 | A | 1/1995 | Doane et al. | |
| 5,453,863 | A | 9/1995 | West et al. | |
| 5,644,330 | A | 7/1997 | Catchpole et al. | |
| 5,748,277 | A | 5/1998 | Huang et al. | |
| 5,933,203 | A | 8/1999 | Wu et al. | |
| 6,034,752 | A | 3/2000 | Khan et al. | |
| 6,133,895 | A | 10/2000 | Huang | |
| 6,154,190 | A | 11/2000 | Yang et al. | |
| 6,268,840 | B1 | 7/2001 | Huang | |
| 6,690,443 | B1 * | 2/2004 | Poliakine | 349/152 |
| 6,710,760 | B1 | 3/2004 | Johnson et al. | |
| 6,717,561 | B1 | 4/2004 | Pfeiffer et al. | |
| 6,784,968 | B1 | 8/2004 | Hughes et al. | |
| 6,894,668 | B2 | 5/2005 | Mi et al. | |
| 7,068,250 | B2 | 6/2006 | Jones | |
| 7,193,767 | B1 | 3/2007 | Peeri | |
| 7,307,608 | B2 | 12/2007 | Stephenson et al. | |
| 7,432,899 | B2 | 10/2008 | Johnson | |
| 2003/0231172 | A1 * | 12/2003 | Kitaoka et al. | 345/211 |
| 2004/0145550 | A1 | 7/2004 | Chen et al. | |
| 2006/0152457 | A1 | 7/2006 | Kitaoka et al. | |
| 2007/0285611 | A1 | 12/2007 | Nose et al. | |

FOREIGN PATENT DOCUMENTS

| | | |
|---|---|---|
| WO | WO 01/08130 | 2/2001 |
| WO | WO 2005/114633 | 12/2005 |
| WO | WO 2008/023415 | 2/2008 |

OTHER PUBLICATIONS

A. Khan et al., Novel Drive Techniques and Temperature Compensation Mechanisms in Reflective Cholesteric Displays, SID 04 Digest, p. 886-889 (2004).

International Search Report, Ref: 64460WO003, PCT/US2009/056876, Apr. 23, 2010.

Supplementary European Search Report in European Patent Application No. 09 81 6701.8, dated Feb. 17, 2012.

* cited by examiner

*Primary Examiner* — William Boddie
*Assistant Examiner* — Andrew Schnirel

(57) ABSTRACT

A unipolar gray scale drive scheme for passive matrix displays, more specifically, cholesteric liquid crystal displays, capable of creating any number of desired levels of gray scale. The drive scheme is single stage and can use either an amplitude modulation or a pulse width modulation column voltage signal in combination with a selecting row voltage signal to drive a pixel receiving the two intersecting signals to a desired level of gray scale.

10 Claims, 9 Drawing Sheets

UNIPOLAR GRAY SCALE DRIVE SCHEME FOR CHOLESTERIC LIQUID CRYSTAL DISPLAYS

FIELD OF THE INVENTION

The present disclosure relates to drive schemes for passive matrix display systems. More specifically, the present disclosure relates to gray scale drive schemes for cholesteric liquid crystal display systems.

BACKGROUND

Cholesteric liquid crystal displays (ChLCD's) have existed for several decades. ChLCD's are unique because of their "nonvolatile memory" characteristic; once an image is written to a display, the current image will remain indefinitely until a new image is written. ChLCD's can also be viewed in ambient light without back lighting. Both of these characteristics significantly reduce total power consumption when compared to other displays.

On the other hand, ChLCD's have inherently slow refresh rates. In an effort to address slow refresh rates associated with ChLCD's, drive schemes for ChLCD's have evolved significantly and have become very complex. Known drive schemes include bipolar and multi-phase drive schemes. Bipolar drive schemes frequently have insufficient voltage to effectively drive a ChLCD, and the complexity of both bipolar and multi-stage drive schemes results in high costs.

There exists a need for a simple, low cost way to achieve gray scale reflection using unipolar drive signals.

SUMMARY

One aspect of the present invention includes a method for driving at least a portion of a passive matrix display system having rows and columns forming pixels. The method includes initially driving the portion of the passive matrix display system to a uniform state. It also includes outputting a column voltage signal that oscillates between two non-negative voltages, where at least three different sets of non-negative voltages cause three different states of the gray scale reflectivity of the pixels. Finally, it includes outputting a first row voltage signal oscillating between a non-planar voltage and a planar voltage which is applied to a row of the matrix being written; and outputting a second row voltage signal where the difference between the second row voltage signal and the column voltage signal at any time is sufficiently low that a state of a pixel receiving the voltage signal will remain substantially unchanged and that is applied to all rows of the matrix not currently being written.

Another aspect of the present disclosure includes a system for driving a display using the described method and including a column driver for outputting column voltage signals and a row driver for outputting row voltage signals.

Another aspect of the present disclosure includes a system for driving a display using the above described method and also including a passive matrix display, a column driver for outputting column voltage signals, a row driver for outputting row voltage signals, and a controller, electrically coupled to the display and column and row drivers, which controls the column and row voltage signals.

Another aspect of the present disclosure includes a method for driving at least a portion of a passive matrix display system having rows and columns forming pixels. The method includes initially driving the portion of the passive matrix display system to a uniform state. It also includes outputting a column voltage signal, cycling through four non-negative voltage levels, wherein the first voltage level is sufficiently high to change the pixel state to a planar reflective state, the second voltage will put the pixel into a weakly scattering focal conic state, the third voltage is sufficiently low that it cannot substantially change the pixel state, and the fourth voltage is the difference between the first voltage and the second voltage. The time period for the first and third voltages is proportional to t1 and a time period for the second and fourth voltages is proportional to t2, where:

$$t1 = \frac{n \times driveperiod}{2(N-1)}$$

$$t2 = \frac{(N-1-n)(driveperiod)}{2(N-1)}$$

The parameter N is a total number of desired levels of gray scale, and the parameter n is a number representing a particular desired level of gray scale within the range of 0 to N−1. Drive period is a length of time inversely proportional to a frequency of oscillation of the row voltages. The method also includes outputting a first row voltage signal oscillating between a non-planar voltage and a planar voltage that is applied to a row of the matrix being written. Finally, it includes outputting a second row voltage signal oscillating between a first voltage and a second voltage, wherein the difference between the second row voltage signal and column voltage signal at any time is sufficiently low that a state of a pixel receiving the second row voltage signal and the column voltage signal will remain substantially unchanged, and that is applied to all rows of the matrix not currently being written.

Another aspect of the present disclosure includes a system for driving a display using the above described method and also including a passive matrix display, a column driver for outputting column voltage signals, a row driver for outputting row voltage signals, and a controller electronically coupled to the display and column and row drivers which controls the column and row voltage signals.

DETAILED DESCRIPTION

Cholesteric Liquid Crystal Display and Electrical System

Figure 1:
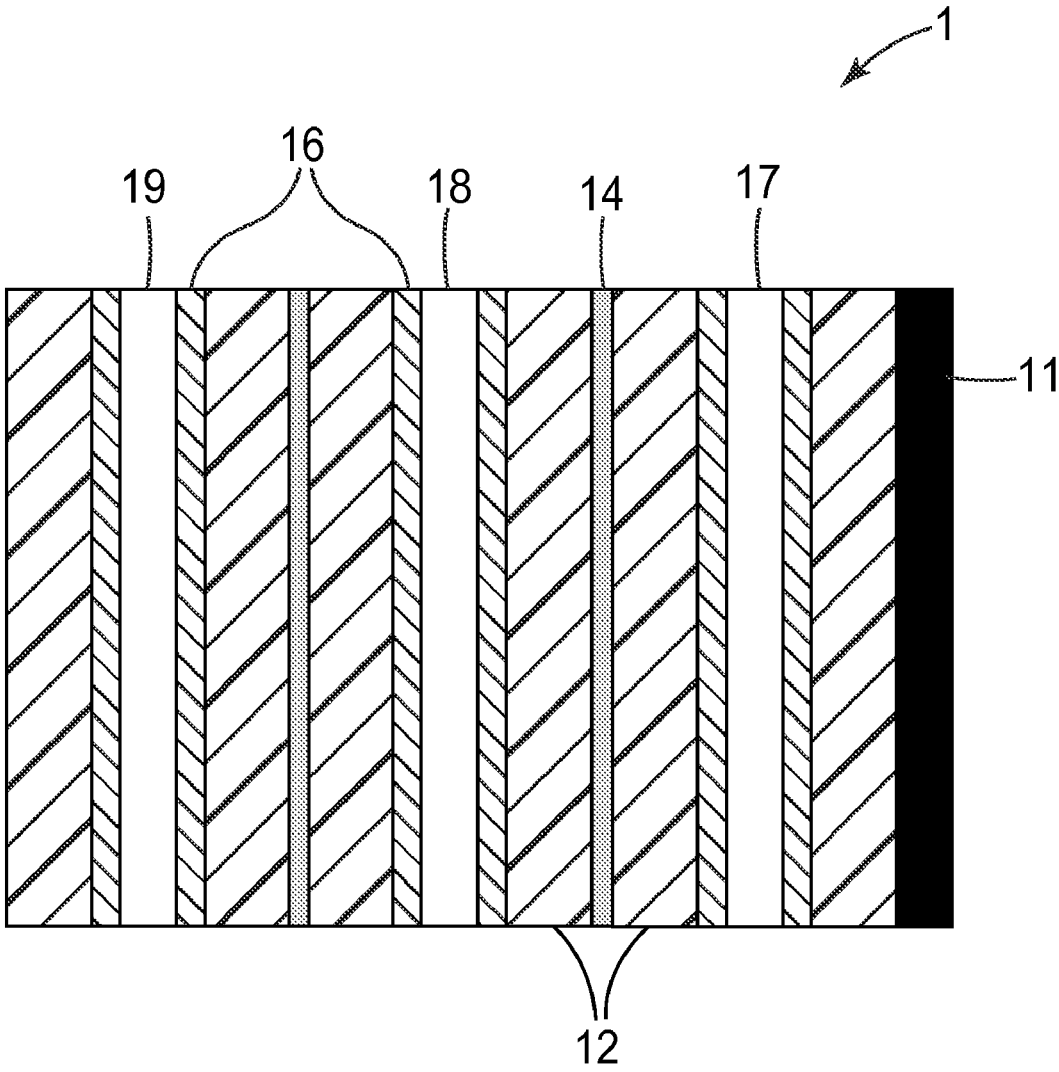
FIG. 1 shows a cross-sectional view of a portion of an exemplary cholesteric liquid crystal display module.

The current disclosure includes a passive matrix display, which may be, for example, a cholesteric liquid crystal display as shown in FIG. 1. An exemplary ChLCD is described in U.S. Pat. No. 5,453,863, incorporated herein by reference as if fully set forth. Alternatively, other types of passive matrix displays may be used. The exemplary ChLCD module shown in FIG. 1 contains three active layers 17, 18, 19. The active layers can correspond with the colors red 17, green 18 and blue 19, and each layer can be addressed by its own pair of indium-tin oxide (ITO) electrodes 16. Alternatively, a display may contain fewer active layers or more active layers. For example, a display may contain multiple active layers for certain colors or additional contrast layers.

Figure 2:
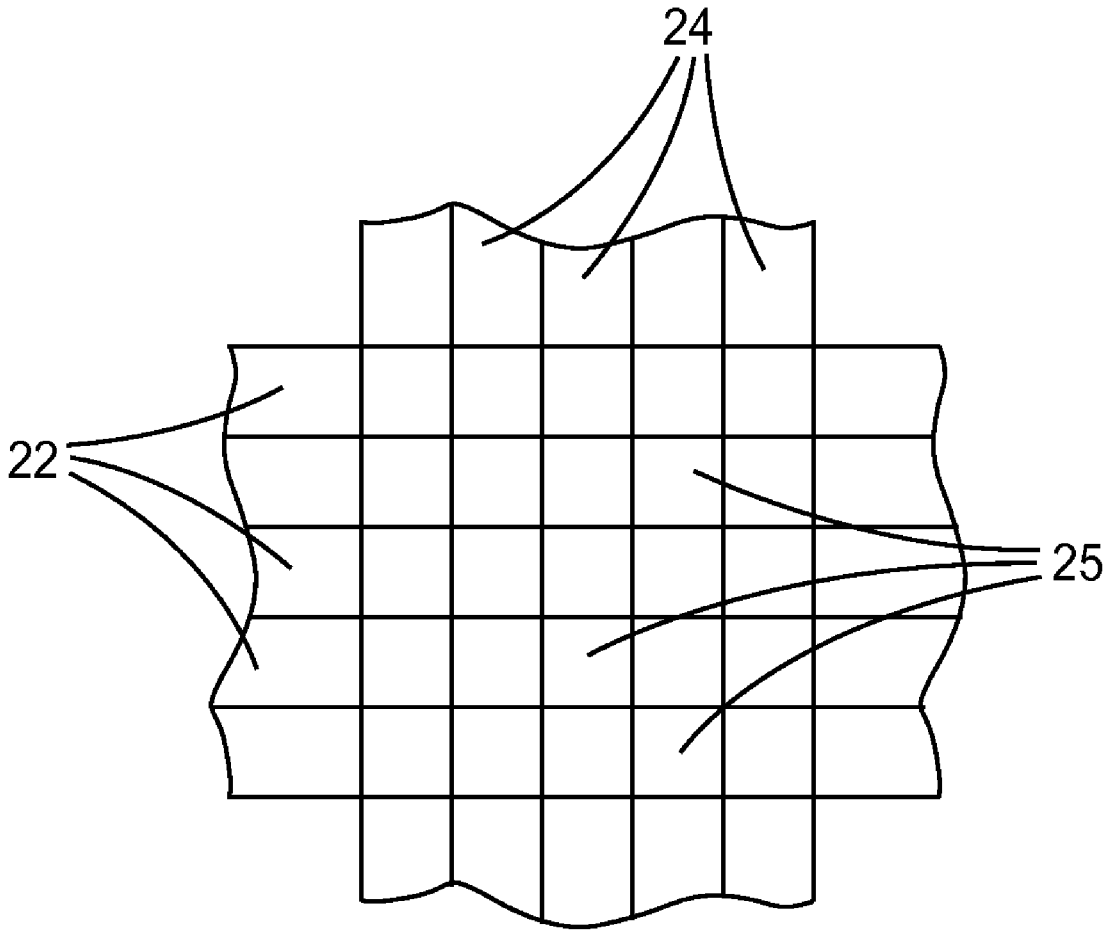
FIG. 2 shows a schematic diagram of an active layer containing rows, columns, and pixels.

As shown in FIGS. 1 and 2, each active layer 17, 18, 19 can include a matrix of rows 22 and columns 24 forming pixels 25 that can be controlled individually. Active layers 17, 18, 19 of ChLCD's are typically composed of a chiral nematic liquid crystal material and a cell wall structure. The cell wall structure and the liquid crystal cooperate to form focal conic and twisted planar textures. Such cells have multiple stable optical states characterized by varying degrees of intensity of reflection. Cells can be driven from one state to another using an electric field. The optical state of the material can be changed to a new stable state to reflect any desired level of reflection along a continuum of such states, thus creating a "gray scale." After the electric field is removed, the current state will remain indefinitely.

A layer of substrate 12 can be disposed on each side of the active layers for a total of six layers of substrate 12 within the display stack. Alternatively, for example, a single layer of substrate 12 can be disposed between active layers and on each end of the stack for a total of four layers of substrate 12. Any number of substrate layers 12 can be arranged in any suitable manner. Active layers 17, 18, 19, each surrounded by a conductor 16 and substrate 12, can then be joined with a total of two layers of adhesive 14 to create a full color ChLCD. An exemplary display 1 may also have a background layer 11. The background layer 11 absorbs light not reflected or scattered by the active layers. The background layer may be black, or alternatively, it may be any other color appropriate for light absorption. A display 1 can be enclosed in any suitable material including, but not limited to, glass or flexible plastic.

Figure 3:
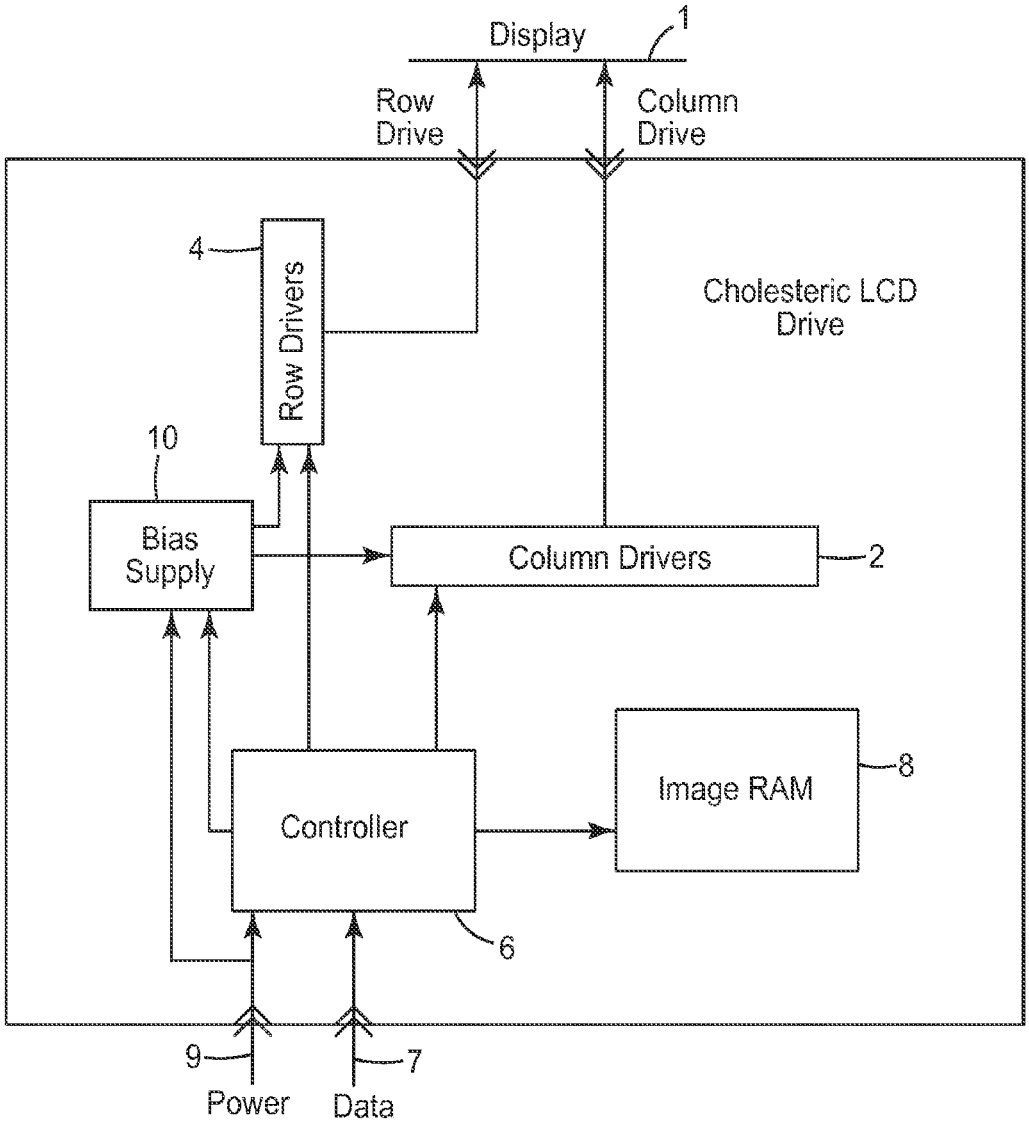
FIG. 3 shows a block diagram of an exemplary system for driving a ChLCD module consistent with the present disclosure.

FIG. 3 shows a block diagram of an exemplary system for driving a display 1 consistent with the present disclosure. Each active layer of the display 1 can be driven by both a column driver 2 and a row driver 4. The signals propagated by the column driver 2 and row driver 4 intersect to control the state of each individual pixel. The column driver 2 and row driver 4 can include a single electronic device or two or more electronic devices. For example, the HV633PG, a 32-channel 128-level display driver manufactured by Supertex, Inc. can be used. Each driver 2, 4 can be powered by a bias voltage supply 10. The bias voltage supply 10 can be monitored by the controller 6 and powered by a power source 9, which also provides power to the controller 6. For example, the controller 6 could be a PIC microcontroller made by Microchip Technology, Inc. Alternative power, voltage, controller and driver configurations consistent with the present disclosure will be apparent to individuals skilled in the art.

When writing a desired image to a display 1, the controller 6 receives input data 7 from an outside source, for example, a user interface, regarding what image or images should be displayed. The controller 6 then accesses the associated image data stored in RAM 8. Using this information, the controller transmits data to the column driver 2 and row driver 4 indicating what signal should be applied to each row and each column of the display, along with the appropriate number of periods over which the signal should be transmitted. The display can be floated at a constant positive voltage level to allow an AC voltage signal to range from zero or some lower positive voltage to a higher voltage.

Pixel Response

Figure 4:
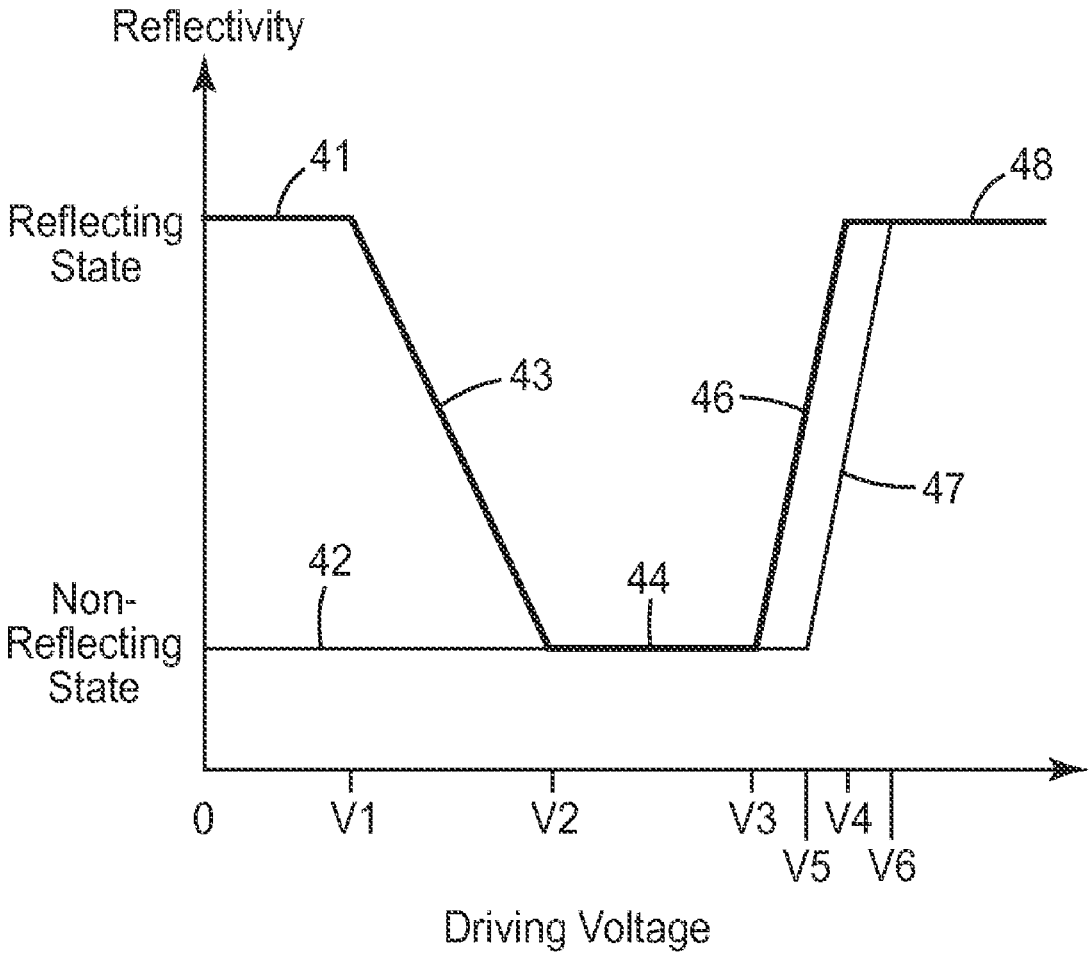
FIG. 4 shows a diagram illustrating the reflectivity of a cholesteric liquid crystal pixel versus an amount of voltage applied to the pixel.

FIG. 4 illustrates a response of a pixel in an active layer to varying voltage levels. Examples of appropriate ranges for voltage levels are in Table 1 below.

TABLE 1

Voltage levels and corresponding example ranges.

| Voltage Level | Example Range |
|---|---|
| V1 | 3-10 V |
| V2 | 5-10 V |
| V3 | 10-25 V |
| V4 | 20-31 V |
| V5 | 10-31 V |
| V6 | 20-40 V |

The response of a pixel to a given voltage level is dependent on the initial pixel state. When a pixel is initially in a planar reflective state 41, application of a sufficiently low voltage to the cell, less than V1, will not substantially change the state of the pixel. As shown in FIG. 4, a planar reflective state 41 results in substantially the highest level of reflection for a given pixel. When a voltage between V1 and V2 is applied to a pixel initially in a planar reflective state, the resulting reflective state 43 is gray scale and is dependent upon, but not linearly related to, the precise level of voltage applied.

If a pixel is initially in a focal conic state 42, application of any voltage less than V2 to the pixel will not substantially change the pixel state. As shown in FIG. 4, a pixel in a focal conic state 42 has a very low level of reflection. Instead, the pixel scatters light, resulting in a black appearance.

Application of a voltage between V2 and V3 to a pixel with any initial state will drive the pixel to a focal conic state 44. Application of a voltage between V3 and V4 to a pixel with an initial planar reflective state will result in a gray scale reflective state 46 dependent upon, but not linearly related to, the level of voltage applied. Application of a voltage between V5 and V6 to a pixel with an initial focal conic reflective state will result in a gray scale reflective state 47 dependent upon, but not linearly related to, the level of voltage applied. Finally, the application of a voltage greater than V6 to a pixel with any initial reflective state will drive the pixel to a planar reflective state 48.

Each pixel 25 in a display receives a row voltage signal and a column voltage signal simultaneously. The row voltage signal and column voltage signal correspond to the row 22 and column 24 which intersect at the location of the pixel 25. The total voltage applied to a pixel at any given point in time is the difference between the row voltage signal and column voltage signal that intersect at that pixel. Each time an image is displayed, all pixels contained in the display can be initially driven to a uniform state, for example, a planar reflective state. Driving pixels to an initial uniform state can result in a more uniform and higher contrast appearance of the subsequently displayed image. The desired image is then written to the display by changing each pixel in each active layer to the desired level of reflectivity. In the display writing process, column voltage signals can primarily control the level of reflectivity while row voltage signals can control which row is being written at any given time. Alternatively, row voltage signals could primarily control the level of reflectivity while column voltage signals could control which column is being written at any given time.

Voltage levels V1, V2, V3, V4, V5 and V6 may vary with each individual active layer in a display. The key voltage levels to be determined for each state are V3, which will drive a pixel to a focal conic state, and V4, which will drive a pixel to a planar state. Exemplary voltages used for active layers 17, 18, 19 shown in FIG. 1 are shown in Table 2 below.

TABLE 2

Example voltage levels for various active display layers.

| Active Layer | V3 | V4 |
|---|---|---|
| Red 17 | 18 V | 23 V |
| Green 18 | 20 V | 26 V |
| Blue 19 | 24 V | 30 V |

Figure 5A:
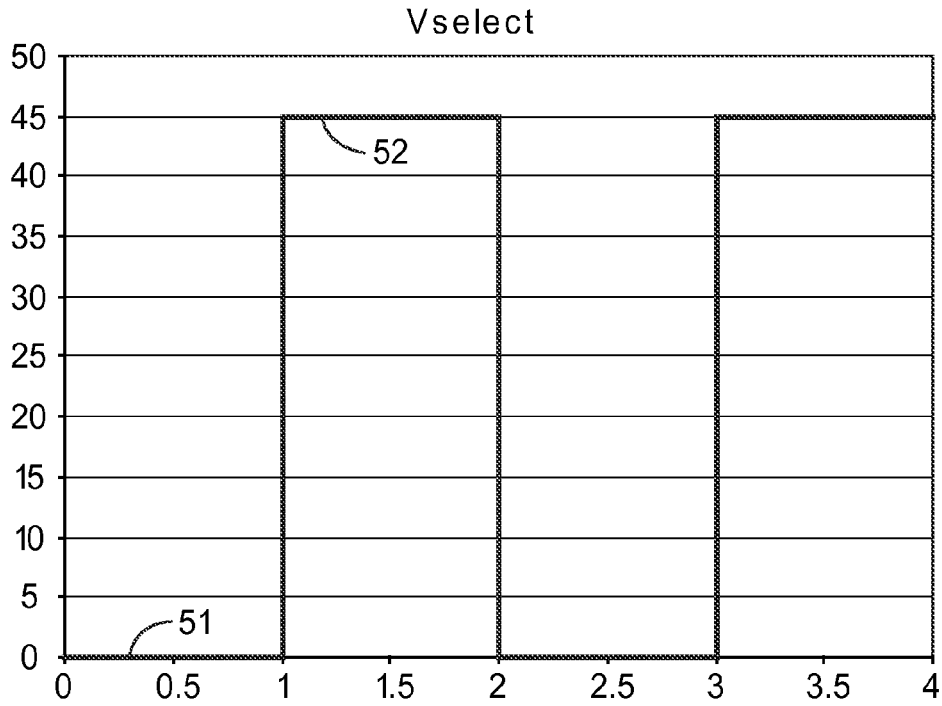
FIG. 5A shows an exemplary first row voltage signal over two periods.
Figure 5B:
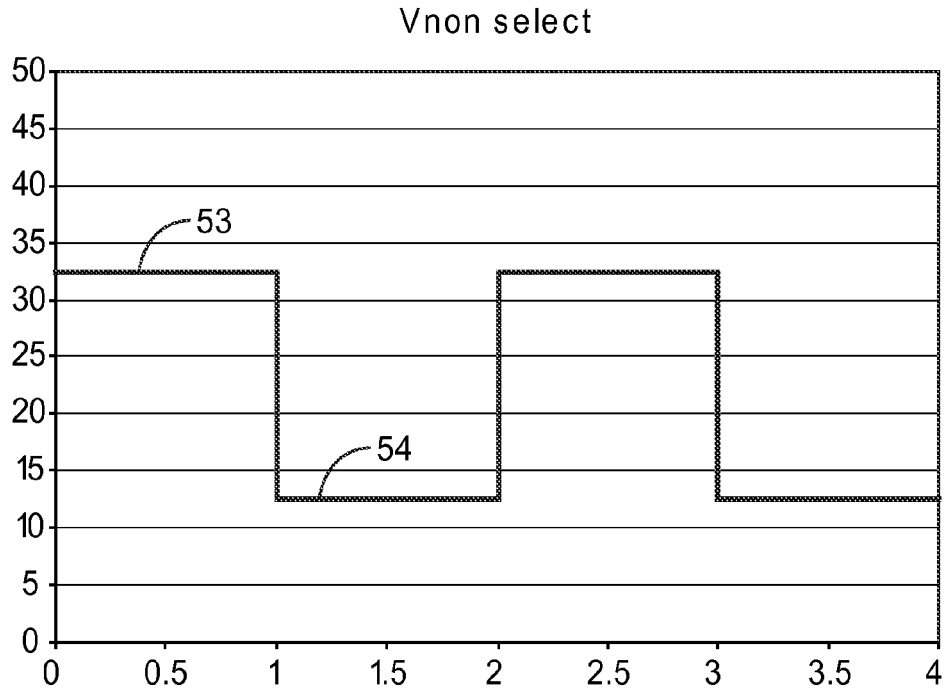
FIG. 5B shows an exemplary second row voltage signal over two periods.

FIGS. 5A-5B show exemplary row voltage signals for configurations using either amplitude modulation or pulse width modulation. Vselect, the voltage signal illustrated in FIG. 5A can be transmitted to a row currently being written. The minimum voltage level 51 is approximately equal to zero and the maximum voltage level 52 is approximately equal to V4 shown in FIG. 4. Alternatively, row voltage levels 51, 52 can be increased or decreased. If a row voltage level 51, 52 is increased or decreased, the voltage that the display is floated at should also be adjusted so that it remains at the center voltage between minimum 51 and maximum 52. FIG. 5B illustrates a voltage signal that can be transmitted to all rows not being written at any given time. Vnonselect, the voltage signal shown in FIG. 5B is 180 degrees out of phase with the voltage signal shown in FIG. 5A. The maximum voltage level 53 is approximately equal to the sum of V4 and V3 divided by two ((V4+V3)/2). The minimum voltage level 54 is approximately equal to the difference between V4 and V3 divided by two ((V4−V3)/2).

Exemplary row voltage signals in FIG. 5A-5B are shown over two periods. The length of a period can vary. An exemplary period may be 0.01 seconds, or as long as about 0.02 seconds or longer, or as short as about 0.002 seconds or shorter. The frequency of oscillation for a row voltage signal such as those shown in FIGS. 5A-5B is inversely related to the period. And exemplary frequency may be about 100 Hz, or as low as about 50 Hz or lower, or as high as about 500 Hz or higher.

Amplitude Modulation Driver

FIGS. 6A-6D show exemplary column voltage signals for use in an amplitude modulation driving method. These column voltage signals can be used in conjunction with row signals such as the exemplary signals illustrated in FIG. 5A-5B. Row voltage signals and column voltage signals should have the same frequency and period.

Figure 6A:
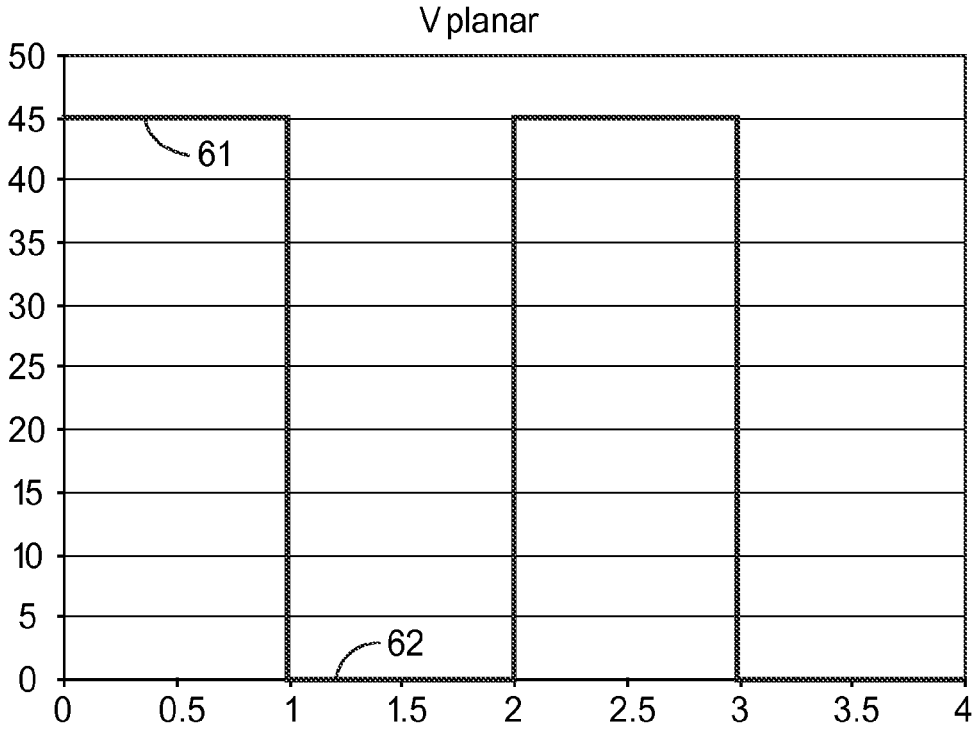
FIG. 6A shows an exemplary column voltage signal over two periods resulting in a planar state for use in amplitude modulation.

The column voltage signal illustrated in FIG. 6A can change a pixel's state to planar reflective. The maximum voltage level 61 is approximately equal to V4, and the minimum voltage level 62 is approximately zero. The column voltage signal shown in FIG. 6A is approximately in-phase with the row voltage signal shown in FIG. 5B. When the voltage signal shown in FIG. 6A is applied to a given column, the pixel in that column receiving a row voltage signal as illustrated in FIG. 5A will receive a cumulative voltage signal alternating between negative and positive V4, and will be changed to a planar reflective state. Pixels receiving a row voltage signal as shown in FIG. 5B will receive a cumulative voltage signal alternating between the negative and positive of the difference between V3 and V4 divided by two ((V3−V4)/2). Because the region from zero volts to V1 should not change the state of the pixel, it is preferable to use ChLCD displays that have the following characteristic: V1 is greater than or equal to the difference between V4 and V3 divided by two ((V4−V3)/2).

Figure 6B:
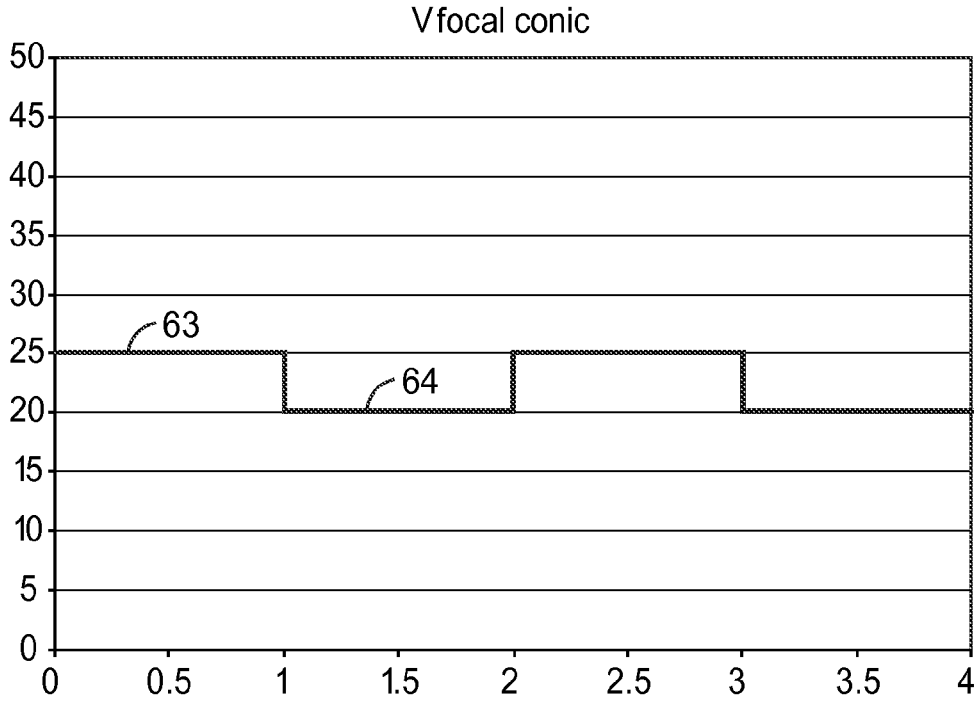
FIG. 6B shows an exemplary column voltage signal over two periods resulting in a focal conic state for use in amplitude modulation.

The column voltage signal illustrated in FIG. 6B can change a pixel's state to focal conic. The maximum voltage level 63 is approximately equal to V3 and the minimum voltage level 64 is approximately equal to the difference between V4 and V3. When the voltage signal shown in FIG. 6B is applied to a given column, the pixel in that column receiving a row voltage signal as illustrated in FIG. 5A will receive a cumulative voltage signal alternating between positive and negative V3, a voltage level sufficient to drive the pixel state to focal conic. The pixels in that column receiving a row voltage signal as illustrated in FIG. 5B will receive a cumulative voltage signal alternating between the positive and the negative of the difference between V4 and V3 divided by two ((V4−V3)/2). Because this signal is less than or equal to V1, the state of the pixels receiving this signal will not change.

Figure 6C:
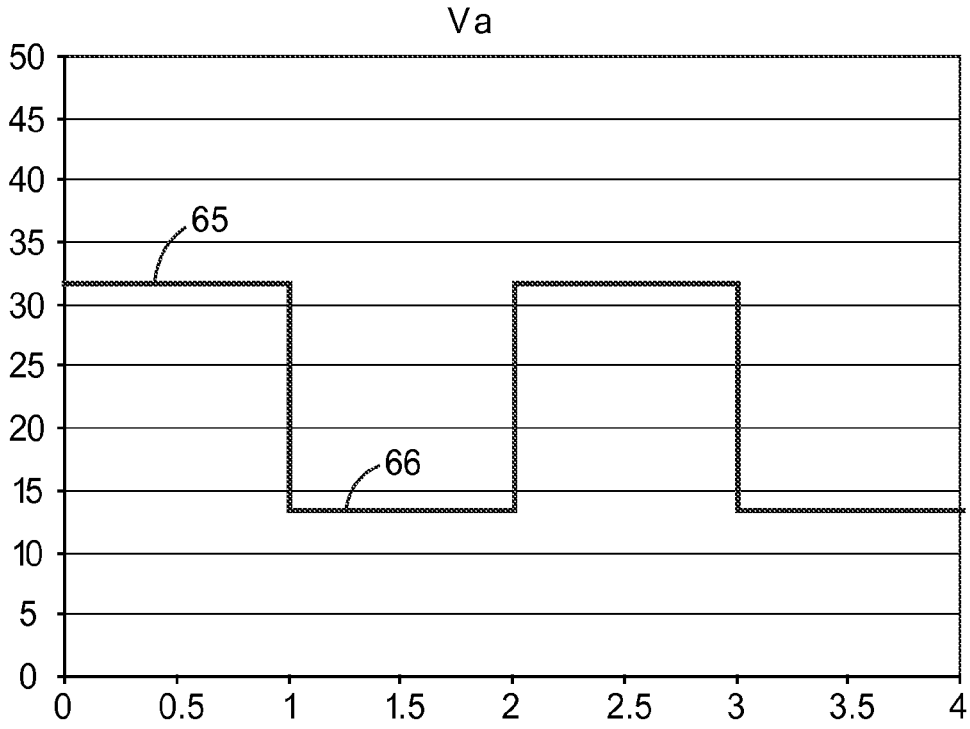
FIG. 6C shows an exemplary column voltage signal over two periods resulting in approximately twenty-five percent reflection for use in amplitude modulation.

Va, the column voltage signal illustrated in FIG. 6C can change a pixel's state to 25% of the reflection of a planar reflective level. The maximum voltage level 65 was determined by experimentally characterizing the response of a pixel to differing voltage levels and using this information to find the necessary column voltage based on row voltage levels to achieve the desired level of reflectivity. Maximum voltage level 65 was then hardwired into the controller. The minimum voltage level 66 can be determined and hardwired in the same manner.

These equations ensure that all gray scale voltage levels will be between a voltage required to produce a focal conic state and a voltage required to produce a planar state. As a result, all pixels not currently being written and receiving a voltage signal such as that shown in FIG. 5B will receive a cumulative voltage less than V1 and will not visually change from their current state.

Figure 6D:
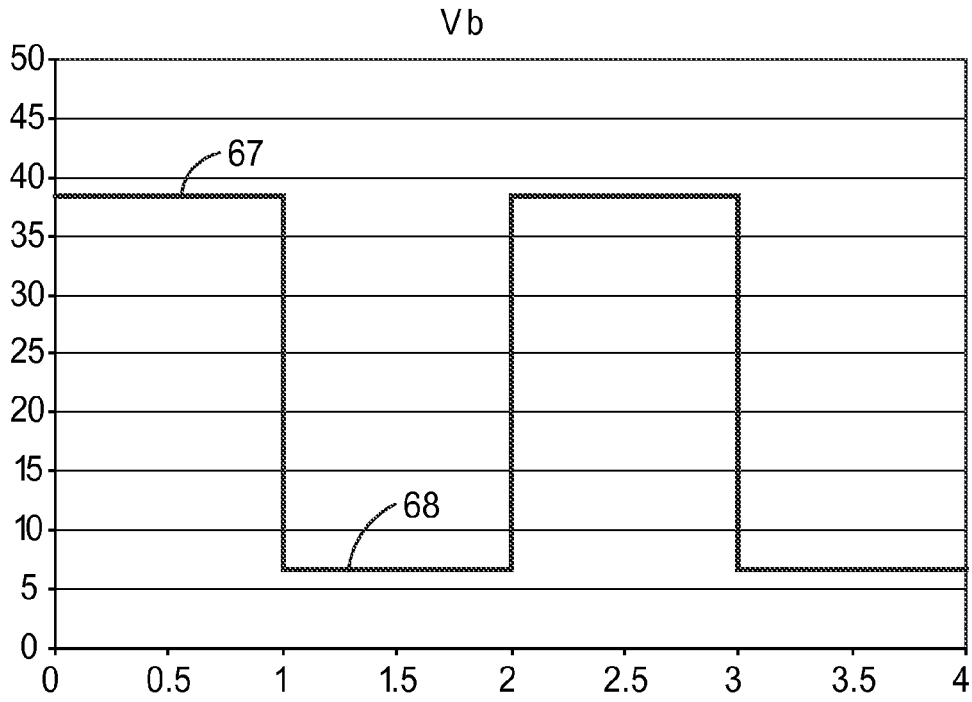
FIG. 6D shows an exemplary column voltage signal over two periods resulting in approximately seventy-five percent reflection for use in amplitude modulation.

Vb, the column voltage signal illustrated in FIG. 6D can change a pixel's state to 75% of the reflection of a planar voltage. Maximum and minimum voltage levels 67, 68 can be found using the same method used to find maximum and minimum voltage levels 65, 66.

While the four column voltage signals illustrated in FIGS. 6A-6D show voltage signals that can be used to achieve four gray scale shades, any number of shades can be achieved using experimental methods to determine minimum 66, 68 and maximum 65, 67 voltage levels. Additionally, shades can have any variety of levels and increments. For example, a four shade gray scale system can have shades for a focal conic state, thirty-three percent reflection of a planar voltage, sixty-six percent reflection of a planar voltage, and a planar reflective state.

Pulse Width Modulation Driver

Figure 7A:
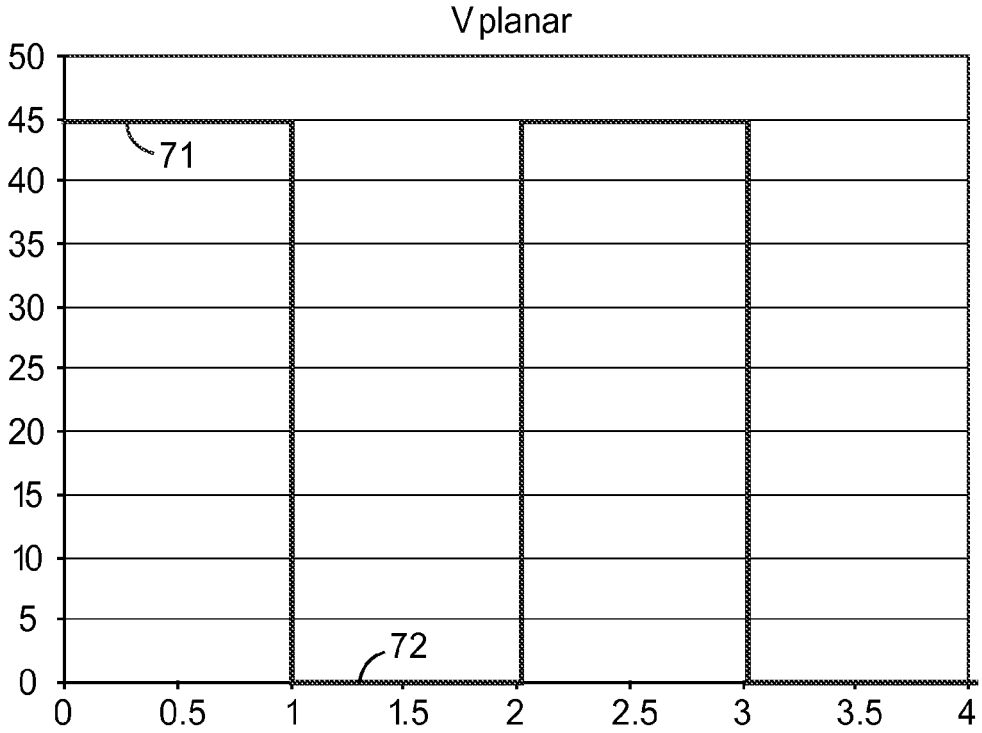
FIG. 7A shows an exemplary column voltage signal over two periods resulting in a planar state for use in pulse width modulation.
Figure 7B:
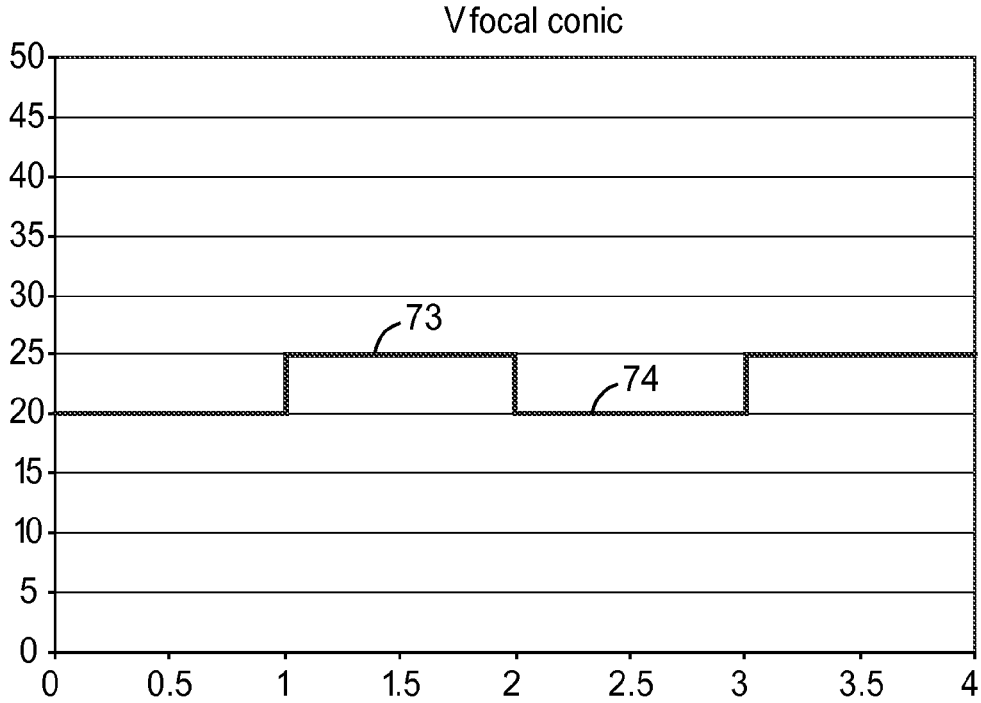
FIG. 7B shows an exemplary column voltage signal over two periods resulting in a focal conic state for use in pulse width modulation.
Figure 7C:
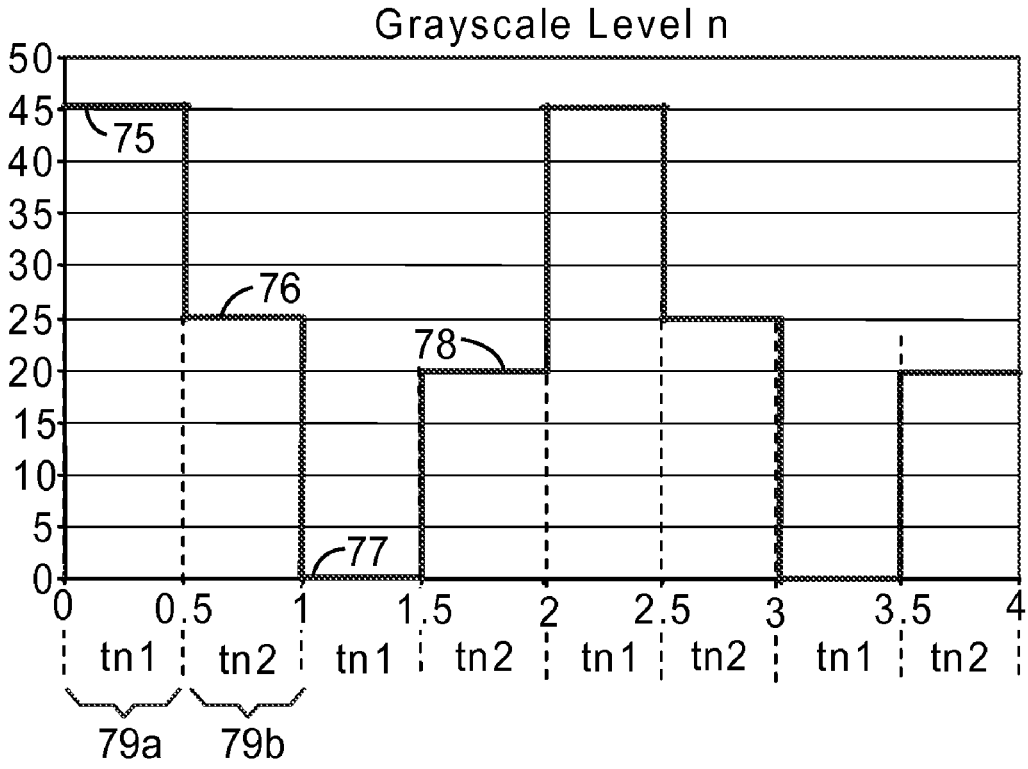
FIG. 7C shows an exemplary column voltage signal over two periods resulting in a desired level of gray scale for use in pulse width modulation.

A drive system consistent with the present disclosure can also use pulse width modulation to generate column voltage signals as illustrated in FIGS. 7A-7C. The exemplary column voltage signals shown in FIGS. 7A-7C can be used in combination with row voltage signals such as the exemplary signals shown in FIGS. 5A-5B. Row voltage signals and column voltage signals must have the same frequency and period.

The column voltage signal illustrated in FIG. 7A can change a pixel's state to planar reflective. The maximum voltage level 71 is approximately equal to or greater than V4, and the minimum voltage level 72 is approximately zero. The column voltage signal shown in FIG. 7A is approximately in-phase with the row voltage signal shown in FIG. 5B. When the voltage signal shown in FIG. 7A is applied to a given column, the pixel in that column receiving a row voltage signal as illustrated in FIG. 5A will receive a cumulative voltage signal alternating between negative and positive V4, and will be changed to a planar reflective state regardless of the pixel's initial state. Pixels receiving a row voltage signal as shown in FIG. 5B receive a cumulative voltage signal alternating between the negative and positive of the difference between V3 and V4 divided by two ((V3−V4)/2).

The column voltage signal illustrated in FIG. 7B can change a pixel's state to focal conic. The maximum voltage level 73 is approximately equal to V3 and the minimum voltage level 74 is approximately equal to the difference between V4 and V3. When the voltage signal shown in FIG. 7B is applied to a given column, the pixel in that column receiving a row voltage signal as illustrated in FIG. 5A receives a cumulative voltage signal alternating between positive and negative V3, a voltage level sufficient to drive the pixel state to focal conic. The pixels in that column receiving a row voltage signal such as illustrated in FIG. 5B will receive a cumulative voltage signal alternating between the positive and the negative of the difference between V4 and V3 divided by two ((V4−V3)/2). Because this signal is less than or equal to V1, the state of the pixels receiving this signal will not change.

The column voltage signal illustrated in FIG. 7C can drive a pixel to a desired level of gray scale, n, within a range of 0 to N−1 levels, where N is the total number of desired levels of gray scale. The signal shown in FIG. 7C extends over two periods, and each period is broken into four time segments, two of each of t1 79*a* and t2 79*b*. The exemplary signal in FIG. 7C cycles through four voltage levels during each period. The first voltage level 75 can have a time period of tn1 and is approximately equal to or greater than V4. Voltage level 75 is sufficiently high to change a pixel to a planar reflective state. The second voltage level 76 can have a time period of t2 and is approximately equal to V3. Voltage level 76 can change a pixel state to a weakly scattering focal conic state. The third voltage level 77 can be 0V and is sufficiently low that it cannot substantially change a pixel state. The fourth voltage level 78 is the difference between the first voltage level 75 and the second voltage level 76.

Time periods t1 and t2 can be determined by using the following equations:

$$t1 = \frac{n \times driveperiod}{2(N-1)}$$

-continued $$t2 = \frac{(N-1-n)(driveperiod)}{2(N-1)}$$

where drive period is a length of time inversely proportional to a frequency of oscillation of the row voltages.

Alternatively, the order of voltage levels can be rearranged to tune a display. However, a first voltage level 75 and third voltage level 77 should still have corresponding time periods of length t1 and a second voltage level 76 and fourth voltage level 78 should still have corresponding time periods of length t2.

Any desired number of shades of gray scale can be achieved by choosing a corresponding value for N. Shades of gray scale, n, ranging from 0 to N−1 are equally spaced.

While the signals shown in FIGS. 5A-7C extend over two drive periods, a signal can be repeated over any desired number of periods to write a pixel. In a preferred embodiment, a signal can be repeated over approximately four periods to achieve a high level of contrast and uniformity.

What is claimed is:

1. A method for driving at least a portion of a passive matrix display system having rows and columns forming pixels, comprising steps of:

(a) initially driving the portion of the passive matrix display system to a uniform state;

(b) outputting to the columns a column voltage signal, cycling through four non-negative voltage levels, wherein the first voltage level is sufficiently high to change the pixel state to a planar reflective state, the second voltage will put the pixel into a weakly scattering focal conic state, the third voltage is sufficiently low that it cannot substantially change the pixel state, and the fourth voltage is the difference between the first voltage and the second voltage, and wherein a time period for the first and third voltages is proportional to t1 and a time period for the second and fourth voltages is proportional to t2, wherein $$t1 = \frac{n \times driveperiod}{2(N-1)}$$

$$t2 = \frac{(N-1-n)(driveperiod)}{2(N-1)}$$

wherein N is a total number of desired levels of gray scale;

n is a number representing a particular desired level of gray scale within the range of 0 to N−1; and drive period is a length of time inversely proportional to a frequency of oscillation of the row voltages;

(c) outputting to the rows a first row voltage signal oscillating between a non-planar voltage and a planar voltage, wherein the first row voltage signal is applied to a row of the matrix being written; and (d) outputting to the rows a second row voltage signal oscillating between a first voltage and a second voltage, wherein the difference between the second row voltage signal and column voltage signal at any time is sufficiently low that a state of a pixel receiving the second row voltage signal and the column voltage signal will remain substantially unchanged, and wherein the second row voltage signal is applied to all rows of the matrix not being written.

2. The method of claim 1 wherein N=32.

3. The method of claim 1 wherein the first row voltage signal, the second row voltage signal and the column voltage signal oscillate at a frequency within the range of 50 Hz to 500 Hz.

4. The method of claim 3 wherein each row is written over a length 1, 2, 3, or 4 periods, wherein the period is inversely related to the frequency.

5. A system for driving a display having rows and columns forming pixels comprising:

(a) a passive matrix display having rows and columns forming pixels;

(b) a column driver outputting to the columns a column voltage signal, cycling through four non-negative voltage levels, wherein the first voltage level is sufficiently high to change the pixel state to a planar reflective state, the second voltage will put the pixel into a weakly scattering focal conic state, the third voltage is sufficiently low that it cannot substantially change the pixel state, and the fourth voltage is the difference between the first voltage and the second voltage, and wherein a time period for the first and third voltages is proportional to t1 and a time period for the second and fourth voltages is proportional to t2, wherein $$t1 = \frac{n \times driveperiod}{2(N-1)}$$

$$t2 = \frac{(N-1-n)(driveperiod)}{2(N-1)}$$

wherein N is the total number of desired levels of gray scale; n is a number representing a particular desired level of gray scale within the range of 0 to N−1; and drive period is a length of time inversely proportional to a frequency of oscillation of the row voltages;

(c) a row driver outputting to the rows a first row voltage signal and a second row voltage signal, wherein the first row voltage signal oscillates between a non-planar voltage and a planar voltage, and is applied to a row of the matrix being written; and the second row voltage signal oscillates between a first voltage and a second voltage, the difference between the second row voltage signal and column voltage signal at any time being sufficiently low that a state of a pixel receiving the second row voltage signal and the column voltage signal will remain substantially unchanged, and is applied to all of the rows of the matrix not being written; and (d) a controller electrically coupled to the passive matrix display, the row driver, and the column driver, wherein the controller controls the first row voltage signal, the second row voltage signal, and the column voltage signal.

6. The system of claim 5 wherein the passive matrix display comprises a cholesteric liquid crystal display.

7. The system of claim 5 wherein the cholesteric liquid crystal display comprises a plurality of active layers and each of the active layers is driven independently.

8. The method of claim 5 wherein the first row voltage signal, the second row voltage signal, and the column voltage signal oscillate at a frequency within the range of 50 Hz to 500 Hz.

9. The method of claim 8 wherein each row is written over a length 1, 2, 3, or 4 periods, and the period is inversely related to the frequency.

10. The method of claim 4 wherein N=32.

* * * * *